US006363816B1

(12) United States Patent
Corcoran et al.

(10) Patent No.: US 6,363,816 B1
(45) **Date of Patent: *Apr. 2, 2002**

(54) PROCESS FOR OPENING A CONTAINER WITH A PUSH AND TWIST CAP AND APPARATUS USEFUL THEREFOR

(76) Inventors: Thomas P. Corcoran, 12 N. Run, Bayer Corporation, 100 Bayer Rd.; Gregory J. Musso, 504 Harbor Rd., Bayer Corporation, 100 Bayer Rd.; Nicholas W. Fiore, 121 Laurel La., Bayer Corporation, 100 Bayer Rd.; Kunal K. Chawla, 39 Elizabeth Dr., Bayer Corporation, 100 Bayer Rd., all of Pittsburgh, PA (US) 15205

( * ) Notice: Subject to any disclaimer, the term of this patent is extended or adjusted under 35 U.S.C. 154(b) by 0 days.

This patent is subject to a terminal disclaimer.

(21) Appl. No.: 09/583,796

(22) Filed: May 31, 2000

Related U.S. Application Data

(60) Provisional application No. 60/136,832, filed on Jun. 1, 1999.

(51) Int. Cl.[7] ..... B67B 7/46

(52) U.S. Cl. ..... 81/3.32; 87/3.39

(58) Field of Search ..... 81/3.32, 3.25, 81/3.31, 3.39

(56) References Cited

U.S. PATENT DOCUMENTS

| | | | | | |
|---|---|---|---|---|---|
| 4,102,226 | A | * | 7/1978 | McGuire | 81/3.32 X |
| 4,171,650 | A | * | 10/1979 | Cardinal | 81/3.32 X |
| 4,919,014 | A | * | 4/1990 | Chen et al. | 81/3.32 X |
| 5,329,831 | A | | 7/1994 | Pierce, Jr. et al. | |
| 5,370,019 | A | * | 12/1994 | Sartell et al. | 81/3.32 |
| 5,704,258 | A | | 1/1998 | LeVoie | |

* cited by examiner

*Primary Examiner*—James G. Smith
(74) *Attorney, Agent, or Firm*—Joseph C. Gil; Lyndanne M. Whalen

(57) ABSTRACT

Closed containers with safety caps having a push and twist opening system are opened by compressing the container between the cap gripping means and the base of the apparatus described more fully herein, rotating the base in a clockwise direction, discontinuing contact of the cap gripping means with the safety cap, and lifting the safety cap from the vessel portion of the container.

9 Claims, 2 Drawing Sheets

PROCESS FOR OPENING A CONTAINER WITH A PUSH AND TWIST CAP AND APPARATUS USEFUL THEREFOR

This application is based upon Provisional Application No. 60/136,832 filed Jun. 1, 1999.

BACKGROUND OF THE INVENTION

The present invention relates to a process for opening a closed safety capped medicine bottle which has a lid with a push and twist system for opening (hereinafter referred to as a "safety cap" or a "child resistant cap") and to an apparatus suitable for opening such safety caps.

In order to deter children from consuming medicine and other potentially dangerous materials, such materials are packaged in containers having caps or lids designed to be opened only when a sufficient amount of pressure is supplied simultaneously with twisting of the cap.

Such child resistant caps are essential due to the already high number of child fatalities from the unintended ingestion of prescription medications. Safety caps may, however, be difficult to open for those having physical problems such as rheumatoid arthritis, osteoarthritis, basal joint arthritis, DeQuervain's Tendonitis, Boutonnier Deformity and Carpal Tunnel Syndrome, or any other condition which limits fine motor function of the fingers.

It would therefore be advantageous to have a device which would enable an intended user to more easily open containers with safety caps without reducing the protection against a child opening such containers.

SUMMARY OF THE INVENTION

It is an object of the present invention to provide an apparatus which makes it easier for intended users to open containers having safety caps.

It is another object of the present invention to provide a process for opening containers having safety caps.

It is a further object of the present invention to provide an apparatus for opening containers having safety caps which requires less pressure than is required to open such container when unaided by this apparatus.

These and other objects which will be apparent to those skilled in the art are accomplished by means of the apparatus described more fully below.

DETAILED DESCRIPTION OF THE PRESENT INVENTION

People with conditions which inhibit fine motor function have difficulty manipulating safety caps in the manner necessary to open the containers having these caps. The apparatus of the present invention resolves this problem by using body weight and mechanical assistance instead of fine motor function to open a container with a safety cap.

The present invention relates to a process for opening a container having a safety cap which has a push and twist opening system and to an apparatus suitable for opening such safety caps.

Figure 1:
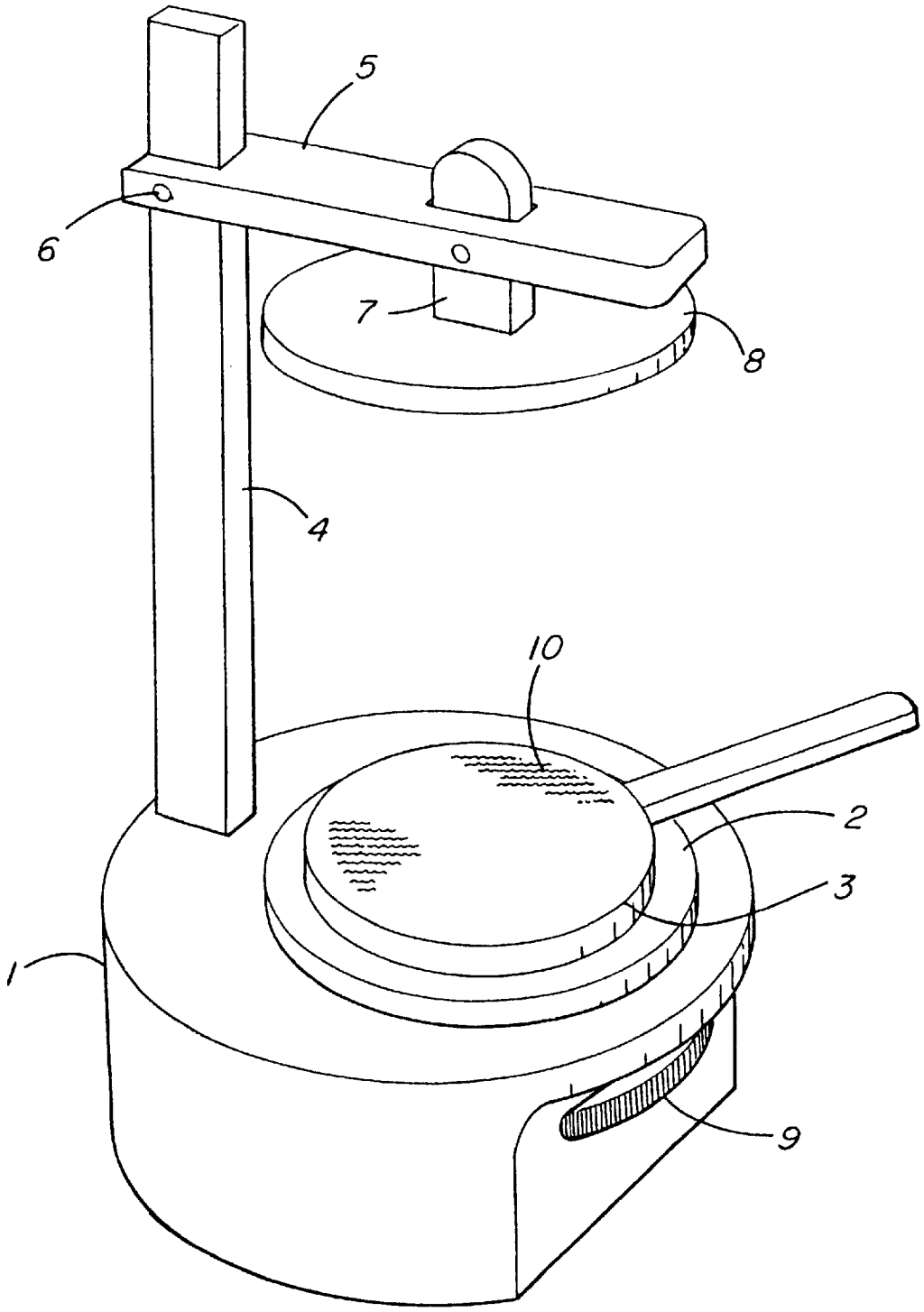
FIG. 1 illustrates the apparatus of the present invention.
Figure 2:
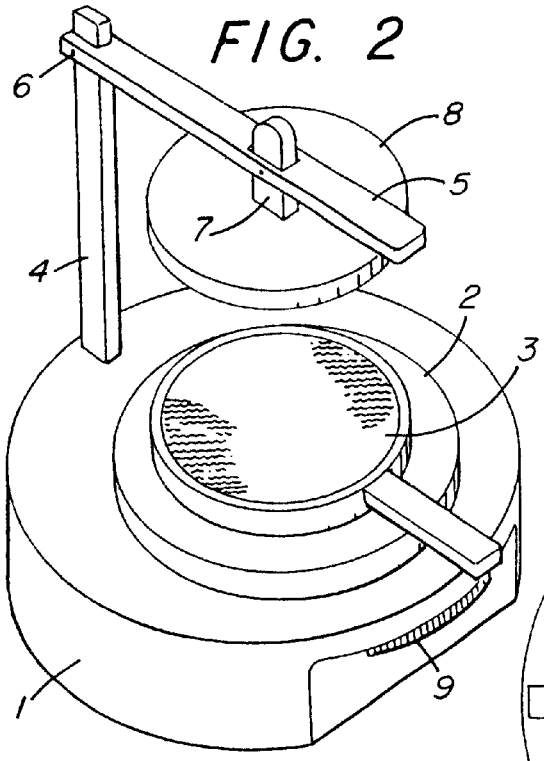
FIG. 2 is a perspective view of the apparatus of the present invention.
Figure 4:
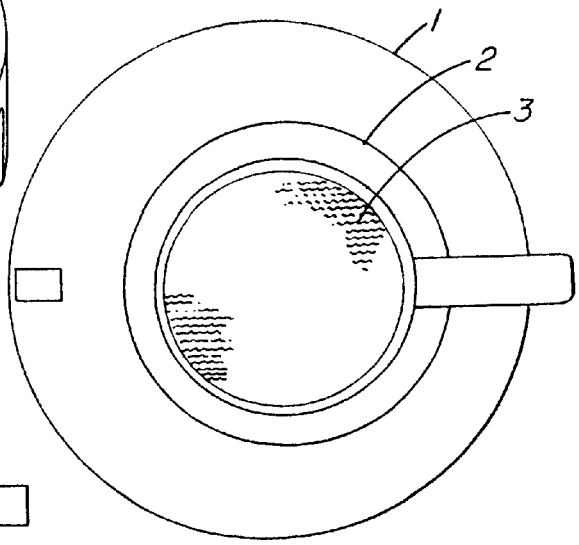
FIG. 4 is an overhead view of the apparatus of the present invention.
Figure 3:
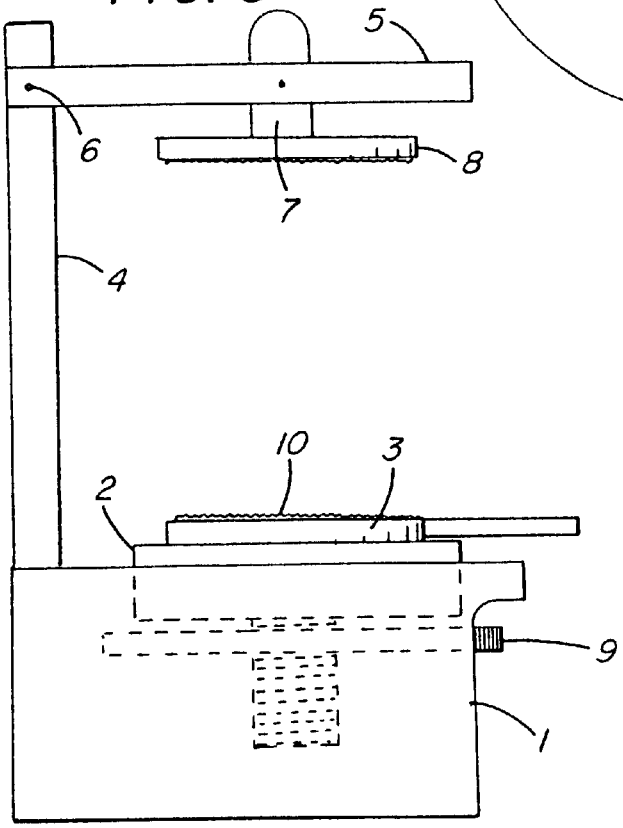
FIG. 3 is a side view of the apparatus of the present invention.

The apparatus of the present invention will be described more fully with specific reference to FIG. 1. An adjusting platform 2 is mounted on foundation 1. A rotating base with handle 3 is mounted on adjusting platform 2 in a manner such that it may be horizontally rotated in a clockwise or clockwise motion by pushing the handle. Vertical post 4 is permanently affixed to foundation 1. Screw mechanism 9 raises and lowers adjusting platform 2. Arm 5 which supports cap gripping means 8 is attached to vertical post 4 by connector means 6. Cap gripping means 8 is connected to arm 5 by movable leveling hinge 7. The gripping surfaces of base 3 and cap gripping means 8 are covered with a material 10 that prevents the vessel and cap of a container-to-be-opened from slipping during the opening process.

Prior to use of the apparatus of the present invention, base 3 is generally positioned so that the handle will be in close proximity to vertical post 4 and the base 3 may be moved in a clockwise direction during the opening process.

In using the apparatus of the present invention, a closed container made up of a safety cap and a receiving vessel is placed upon base 3 in a manner such that the vessel portion of the container will be in contact with base 3. Adjusting platform 2 is raised by turning screw mechanism 9 to adjust the distance between base 3 and cap gripping means 8 to permit the container to be opened to be inserted. Cap gripping means 8 is then brought into contact with the safety cap of the closed container. Sufficient pressure is applied to the closed container to maintain contact between base 3 and the vessel, contact between cap gripping means 8 and the child-resistant cap and to compress the container between cap gripping means 8 and base 3. After application of pressure has begun, the user takes hold of the handle of base 3 and horizontally rotates it about platform 2 in a clockwise direction. Contact between cap gripping means 8 and the safety cap is then discontinued. The container may then be removed from base 3 and the safety cap lifted from the vessel portion of the container.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An apparatus capable of opening a closed container composed of a vessel and a safety cap with a push and twist opening system comprising:

(1) a foundation;

(2) an adjusting platform mounted to the foundation;

(3) a rotating base with a handle which is mounted on the platform in a manner such that the base may be rotated horizontally;

(4) a vertical post which is permanently mounted to the foundation;

(5) an arm to support a cap gripping means;

(6) a pin connector for attaching the vertical post to the arm;

(7) a leveling hinge which connects a cap gripping means to the arm;

(8) a cap gripping means supported by the arm; and (9) a screw mechanism positioned within the foundation for raising and lowering the adjusting platform.

2. The apparatus of claim 1 in which the foundation is circular.

3. The apparatus of claim 1 in which the platform is circular.

4. The apparatus of claim 1 in which the handle of the base is sufficiently long that it extends beyond the foundation.

5. The apparatus of claim 1 in which the cap gripping means is circular.

6. The apparatus of claim 1 in which the foundation and the platform are circular.

7. The apparatus of claim 6 in which the circumference of the foundation is greater than the circumference of the platform.

8. The apparatus of claim 1 in which the base and the cap gripping means each have a surface covered with a material that is capable of preventing slipping of the container during opening.

9. A process for opening a closed container composed of a vessel and a safety cap comprising:

(a) positioning the closed container on the base of an apparatus capable of opening a closed container composed of a vessel and a safety cap with a push and twist opening system comprising:

(1) a foundation;

(2) an adjusting platform mounted to the foundation;

(3) a rotating base with a handle which is mounted on the platform in a manner such that the base may be rotated horizontally;

(4) a vertical post which is permanently mounted to the foundation;

(5) an arm to support a cap gripping means;

(6) a pin connector for attaching the vertical post to the arm;

(7) a leveling hinge which connects a cap gripping means to the arm;

(8) a cap gripping means supported by the arm; and (9) a screw mechanism positioned within the foundation for raising and lowering the adjusting platform in a manner such that the vessel of the container is placed in contact with the base and the safety cap is in contact with the cap gripping means;

(b) applying sufficient pressure to the cap gripping means to maintain contact between the base and the vessel of the container to be opened during the opening process;

(c) holding the handle of the base and turning the base clockwise;

(d) discontinuing contact of the cap gripping means with the safety cap; and (e) lifting the safety cap from the vessel of the container.

* * * * *